United States Patent [19]

Borgen

[11] 3,997,741

[45] Dec. 14, 1976

[54] ADJUSTABLE CONTACT POINT ASSEMBLY FOR DISTRIBUTORS

[76] Inventor: Roger J. Borgen, 2300 - 16th Ave., San Francisco, Calif. 94116

[22] Filed: June 2, 1975

[21] Appl. No.: 582,832

[52] U.S. Cl. ..... 200/31 A; 200/286

[51] Int. Cl.[2] ..... H01H 1/34; H01H 19/62

[58] Field of Search ..... 200/19 R, 19 A, 20, 200/21, 22, 30 R, 30 A, 30 AA, 31 R, 31 A, 286, 249, 259

[56] References Cited

UNITED STATES PATENTS 2,030,488 2/1936 Williams ..... 200/286 X

*Primary Examiner*—James R. Scott

[57] ABSTRACT

A distributor assembly of a type having a rotor, a cyclically operated moving contact carried on a spring-loaded arm within the distributor cap includes an adjustable stationary contact point which is directly advanced and retracted by rotation thereof under the action of an elongate rotatable rod extending to a position exteriorly of the distributor cap. Means are provided for simultaneously moving and continuously locking the adjustable point as it is moved so as to retain the spacing between the points of the distributor.

6 Claims, 2 Drawing Figures

FIG_1
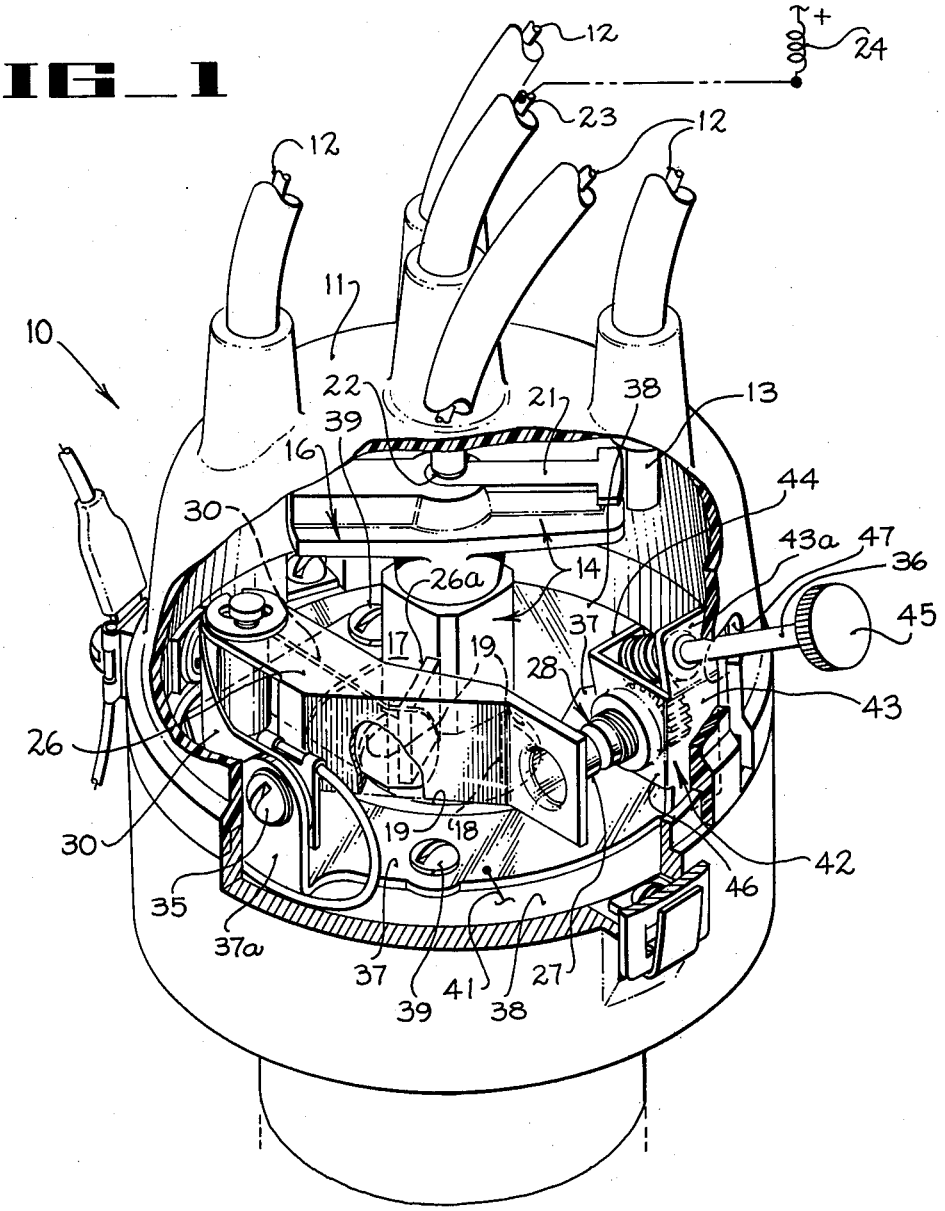
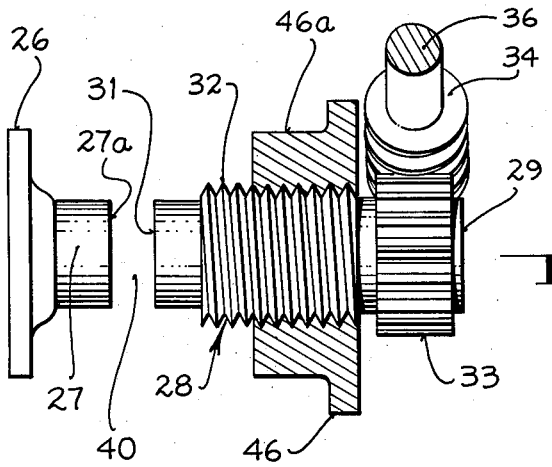
FIG_2

ADJUSTABLE CONTACT POINT ASSEMBLY FOR DISTRIBUTORS

BACKGROUND OF THE INVENTION

This invention pertains to distributors of a type for use in internal combustion engines and more particularly to means for readily adjusting the spacing between a pair of contact points involved in such distributor devices.

In the past, automotive distributors of the general type described have provided for adjustment of the spacing between the cooperating points therein in manners which typically have required at least the removal of the distributor cap whereby the adjustment typically cannot be made while the engine is running.

The foregoing problem has been attempted to be solved in a number of other ways, usually by rotating the supporting base plate for the breaker arm within the distributor cap. In making such adjustments, it is, however, important that the spacing between the two points be established in a positive manner locking the two points from further movement during operation of the engine.

Accordingly, there has been a need for the provision of a means for directly adjusting the stationary distributor point from a position externally of the distributor cap so as to permit the adjustment to be accomplished during the course of operation of the engine and in a manner continuously locking the adjusted point in position so that further disassembly of the distributor is not required.

As disclosed herein the stationary contact point in the distributor is directly moved by rotation thereof in its housing so as to advance and retreat with respect to the confronting surface of a cyclically moving point carried on the end of a breaker arm. Typically, in most distributors, there will be found a moving and a stationary point. In the present instance, it is the stationary point which is adjustable and, accordingly, (to that extent) movable. This should explain the apparent inconsistency in referring to a "movable stationary" point.

SUMMARY OF THE INVENTION AND OBJECTS

In general, in a distributor assembly of a type having a movable breaker arm and a contact point carried by the arm for cyclic movement between advanced and retracted positions in response to the rotation of a cam, there is provided means for simultaneously moving while continuously locking the adjustable stationary point as it is adjusted so as to retain the spacing between the points. In addition for use in a distributor assembly, a contact point element has been employed characterized by an elongate body of conductive material formed at one end with a transverse surface adapted to cooperate with a corresponding surface of another point to form an electric circuit therebetween. Threads are formed coaxially of the body of the element for supporting and causing the body to advance and retreat relative to said corresponding surface of said other point in response to rotation of the body. Means carried by the body are adapted to be engaged and rotated so as to rotate the body to cause the threads to move the body and its transverse surface to advance and retreat with respect to said corresponding surface of the other point and can be moved in opposite directions depending upon the direction of rotation of the adjustable contact point element.

In general, it is an object of the present invention to provide an improved distributor assembly and to provide an improved means for adjusting the distributor from a position disposed externally of the distributor cap.

The foregoing objective serves to permit the distributor to be adjusted as its associated engine is running.

Another object of the invention is to provide means for adjusting the point spacing in a distributor by directly adjusting the stationary point and simultaneously continuously locking the stationary point as it is moved during its adjustment.

BRIEF DESCRIPTION OF THE DRAWING

FIG. 1 shows a perspective view partially broken away of a distributor assembly according to the invention;

FIG. 2 shows an enlarged detail in side elevation section of a portion of FIG. 1.

DETAILED DESCRIPTION OF A PREFERRED EMBODIMENT

A distributor assembly 10 includes an inverted bowl-shaped cap 11 carrying a plurality of four insulated spark plug leads 12 extending downwardly into the bowl portion of cap 11 to provide electrically exposed contacts 13 therein.

A rotor assembly 14 mounted for rotation to be electrically coupled to each of contacts 13 and leads 12 during each revolution of the rotor comprises a rotor arm 16 extending transversely of the axis of rotation of a generally shaped four-sided cam 17 disposed on the upper end of a cylindrical shaft 18 extending downwardly through the bottom of the distributor via opening 19. Arm 16 includes an elongate conductive contact 21 carried on the top side thereof and disposed to ride in contact with the rounded lower end 22 of a lead 23 coupled to a coil 24. Accordingly, for each revolution of rotor arm 16, each of the contacts 13 will be electrically coupled to coil 24. Meanwhile cam 17 rotates to cyclically move a breaker arm 26 to carry its contact point 27 between advanced and retracted positions relative to the adjustable stationary contact point 28 so as to make and break an electric circuit between points 27 and 28.

Means for simultaneously moving and continuously locking the adjustable point 28 as it is moved so as to adjust and retain the spacing between the confronting surfaces of points 27 and 28 comprises the construction of point 28 including an elongate body 29 of conductive material formed at one end with a transverse surface 31 adapted to cooperate with a corresponding surface 27*a* of the moving point 27 so as to form an electric circuit therebetween. Threads 32 formed coaxially of body 29 serve to support and cause body 29 to advance and retreat relative to surface 27 in response to rotation of body 29.

Threaded means engaging threads 32 serve to support body 29 in position to advance and retreat upon rotation of the adjustable contact element 28 to vary the spacing between confronting surfaces of points 28 and 27.

Accordingly, a journal box 42 includes a pair of substantially parallel walls 43, 44 joined together by the side wall 46 characterized by a boss portion 46*a* forming a relatively elongate threaded hole for supporting contact point 28.

A worm wheel 33 carried to rotate with body 29 engages a worm element 34 mounted on the end of an elongate control rod 36 extending from worm element 34 through opening 47 in distributor cap 11 to be operated at a position externally of cap 11 for rotating the adjustable contact point. Worm element 34 and worm wheel 33 mesh with minimal clearance whereby element 34 prevents any rotation originating at point 28. In this manner element 34 retains point 28 in a locked, irreversible state, even when adjusting the gap 40 defined between points 27, 28.

Means simultaneously retaining a base plate member 37 secured in fixed immovable relation to a support member 38 during rotation of point 28 includes a plurality of three screws 39 (two of which are shown) which anchor base plate 37 tightly in fixed relation to the top of support member 38. Base member 37 is connected to ground as indicated at 41.

Means for supporting the elongate control rod 36, its associated worm element 34 and knob 45 comprise the upper end 43*a* of side wall 43 and a suitable journal portion (not shown) formed in the confronting wall 44. Distributor cap 11 includes an opening 47 through which control rod 36 extends and preferably should be sealed against entry of dust, dirt, etc.

From the foregoing, it will be readily evident that there has been provided an improved distributor assembly having means for simultaneously adjusting while continuously locking the stationary distributor point as it is moved for adjusting and retaining the spacing or gap between the adjustable point and the movable point.

The foregoing arrangement permits the points in a distributor to be quite accurately adjusted while permitting the engine to run as adjustments are made. This has the advantage of permitting an adjustment to be made without opening or removing the distributor cap and becoming involved in the extra labor and problems associated with the dismantling of a distributor for purposes of adjustment.

At the same time, not only are the distributor points properly adjusted, but they are continuously being locked in place by the irreversible action of the worm element 34.

I claim:

1. In a distributor assembly of a type having a mounting base member, a support member carrying said base member, a moving breaker arm supported by said base member and having an electric contact point thereon, an inverted bowl-shaped cap carrying a plurality of spark plug leads extending into the bowl portion of said cap, a stationary electrical contact point element, a rotor assembly mounted for rotation to be electrically coupled to each of said leads during each revolution of the rotor, and means including a cam coupled to rotate with said rotor for cyclically moving said breaker arm to carry its said contact point between advanced and retracted positions relative to said stationary point to make and break an electrical circuit between said points, the improvement comprising means carried in fixed relation to said base member for supporting said stationary element to be adjusted axially between advanced and retracted positions, means for simultaneously moving and continuously locking said stationary element to respectively adjust and retain the spacing between said point and said element, and means simultaneously retaining said base member secured in fixed immovable relation to said support member.

2. In an assembly according to claim 1 in which said means for moving and continuously locking said stationary point extends to a position for operation thereof disposed externally of said cap to permit adjustment of said points as the distributor continues to operate.

3. In an assembly according to claim 1 in which said stationary contact element comprises an elongate body including threads disposed about the axis of said body and a worm wheel carried coaxially by said body, in which said means for supporting said stationary element for adjustment includes threaded means therein engaging said threads for supporting said body in position to advance and retreat upon rotation of said stationary contact element to vary the spacing between said points, and means including a worm element for engaging said worm wheel, and an elongate control rod extending from said worm element through said cap to a position externally of said cap for rotating said stationary contact point from a position externally of said cap via said worm element and worm gear.

4. For use in a distributor assembly a contact point element comprising an elongate body of conductive material formed at one end with a transverse surface adapted to cooperate with a corresponding surface of another point to form an electric circuit therebetween, threads formed coaxially of said body, support means including cooperating threads for supporting and causing said body to advance and retreat relative to said corresponding surface in response to rotation of said body, and means carried by said body adapted to be engaged and rotated so as to rotate said body to cause said threads to move said body relative to said support means to carry its transverse surface to advance and retreat with respect to said corresponding surface dependent upon the direction of rotation of said element.

5. For use in a distributor assembly a contact point element comprising an elongate body of conductive material formed at one end with a transverse surface adapted to cooperate with a corresponding surface of another point to form an electric circuit therebetween, threads formed coaxially of said body adapted to cooperate with mating threads of means for supporting said element for engaging threads of said body to support and cause said body to advance and retreat relative to both said corresponding surface and to said supporting means, in response to said rotation of said body, a gear disposed coaxially of and movable with said body and adapted to be rotated by means of a worm element to rotate said body to cause said threads to move said body and its transverse surface to advance and retreat with respect to said corresponding surface and said support means.

6. In a distributor assembly of a type having a movable breaker arm, a contact point carried by said arm, cyclically driven cam means moving said breaker arm and contact point between advanced and retracted positions, the improvement comprising a base member supporting said breaker arm, a mounting bracket carried by said base member in fixed immovable relation to said member, an elongate stationary electric contact point disposed and adapted to be electrically coupled to the movable contact point to make and break an electric circuit therebetween, said mounting bracket serving to carry said stationary point and formed with an opening axially of said stationary point, threads formed in said opening, threads formed about said stationary point and disposed within said opening, means operable from a position externally of said distributor for rotating said stationary contact point to cause said stationary point to advance and retreat relative to said movable point while said mounting bracket remains in fixed relation with respect to said base member to vary the spacing therebetween.

* * * * *